United States Patent [19]

Soupal

[11] Patent Number: 4,710,108

[45] Date of Patent: Dec. 1, 1987

[54] ISOLATION VALVE CONSTRUCTION

[75] Inventor: Thomas R. Soupal, Owosso, Mich.

[73] Assignee: Midland Brake, Inc., Oswosso, Mich.

[21] Appl. No.: 24,624

[22] Filed: Mar. 11, 1987

[51] Int. Cl.[4] ..... F04B 49/00

[52] U.S. Cl. ..... 417/298

[58] Field of Search ..... 417/26, 28, 297, 298

[56] References Cited

U.S. PATENT DOCUMENTS

| | | | |
|---|---|---|---|
| 2,804,378 | 9/1957 | Fishwood | 417/298 |
| 4,060,340 | 11/1977 | Yanik et al. | 417/298 |
| 4,505,648 | 3/1985 | Heger et al. | 417/297 |

FOREIGN PATENT DOCUMENTS

| | | | |
|---|---|---|---|
| 914770 | 5/1954 | Fed. Rep. of Germany | 417/298 |
| 940852 | 11/1963 | United Kingdom | 417/298 |

*Primary Examiner*—William L. Freeh

*Attorney, Agent, or Firm*—Neuman, Williams, Anderson & Olson

[57] ABSTRACT

An isolation valve is provided for use in a pneumatic system having an air compressor operable in normal and unloading modes, an air dryer, a reservoir of charged air, and a governor. The isolation valve includes a housing provided with an internal cavity and having a first port to the cavity communicating with a first port of the compressor, a second port to the cavity communicating with an inlet port of the dryer, and a third port to the cavity communicating with a port of the governor. A pneumatically responsive primary valve member is mounted within the cavity for movement between open and closed positions with respect to the housing second port. The primary valve member is provided with an internal passage having one end in communication with the housing third port and a second end in communication with the housing cavity. A pneumatically responsive secondary valve member is mounted within the passage for movement between blocking and unblocking positions. The secondary valve member is in the blocking position and the primary valve member is in the open position when the compressor is in the normal mode. The secondary valve member is in the unblocking position and the primary valve member is in the closed position when the compressor is in the unloading modes.

12 Claims, 2 Drawing Figures

ISOLATION VALVE CONSTRUCTION

BACKGROUND OF THE INVENTION

It is well known in a turbocharged internal combustion engine equipped with an air dryer that such an engine has a tendency, during unloading of the air compressor, to allow a significant amount of the engine intake air to be diverted through the compressor and dryer and out to the atmosphere when the compressor is in an unloading mode. As a result of this condition there is an inordinate loss of engine power and waste of fuel. Furthermore, during the unloading cycle of the compressor, excessive amounts of oil are caused to pass around the engine piston rings, due to a vacuum or low pressure condition being created above each piston as the latter reciprocates within its respective cylinder without the air intake valve being actuated to an open position.

SUMMARY OF THE INVENTION

Thus, it is an object of the invention to provide an isolation valve of the type described which will prevent the loss of charged air within the pneumatic system when the compressor thereof is in an unloading mode.

It is a further object to provide an isolation valve which will maintain pressure within the compressor exhaust line of the pneumatic system when the compressor is in the unloading mode.

It is still a further object to provide an isolation valve of the type described which is of simple, compact construction and is automatically actuated when the air compressor is in the unloading mode.

It is a still further object to provide an isolation valve for a turbocharged engine which will cause the engine exhaust valve to remain closed while the air compressor is in the unloading mode.

Further, additional objects will appear for the description, accompanying drawing and appended claims.

In accordance with one embodiment of the invention, an isolation valve is provided for use in a pneumatic system having an air compressor operable in normal and unloading modes, an air dryer, a governor, and a reservoir of charged air. The isolation valve includes a housing having an internal cavity, a first port to the cavity in communication with a first port of the compressor, a second port to the cavity in communication with an inlet port of the dryer, and a third port to the cavity in communication with a second port of the governor. The governor is provided with a first port which is in communication with a signal outlet port provided on the reservoir. The second port of the governor is also in communication with an unload signal second port provided on the compressor. When the compressor is in the unloading mode, the first and second ports of the governor are interconnected. Mounted within the housing cavity for movement between open and closed positions relative to the housing second port is a pneumatically responsive primary valve member. The primary valve member is provided with an internal passage having one end thereof in communication with the housing third port and a second end thereof in communication with the housing cavity. Mounted within the passage for movement between blocking and unblocking positions is a pneumatically responsive secondary valve member. When the compressor is operating in the normal mode, the secondary valve member assumes a passage-blocking position and the primary valve member assumes an open position relative to housing second port; thus, causing the reservoir to be charged subsequent to the charged air having passed through the air dryer. When the compressor is in the unloading mode, the primary valve member closes off the housing second port and the secondary valve member is moved to a passage-unblocking position by a charge of pressurized air from the reservoir through the unload signal second port thereof, and through the interconnected first and second ports of the governor. The charged air from the reservoir which effects movement of the secondary valve member to an unblocking position, also activates a pneumatically responsive control within the compressor causing the air intake valve of the compressor to remain open while simultaneously resulting in the exhaust valve of the compressor to remain closed.

DESCRIPTION

For a more complete understanding of the invention reference should be made to the drawings wherein.

Figure 1:
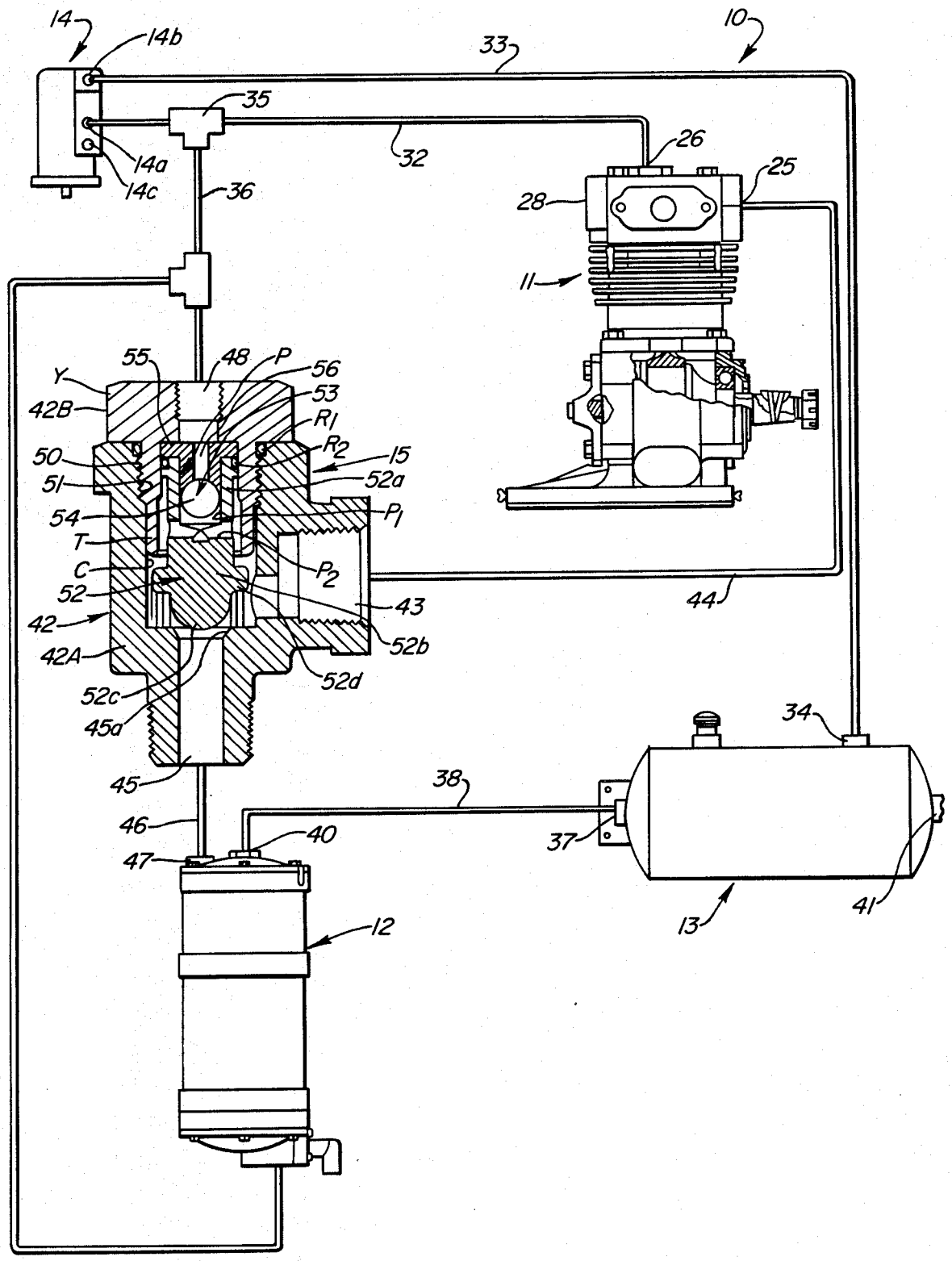
FIG. 1 is a diagram of a pneumatic system which incorporates a preferred embodiment of the isolation valve, the latter being shown in a vertical section.
Figure 2:
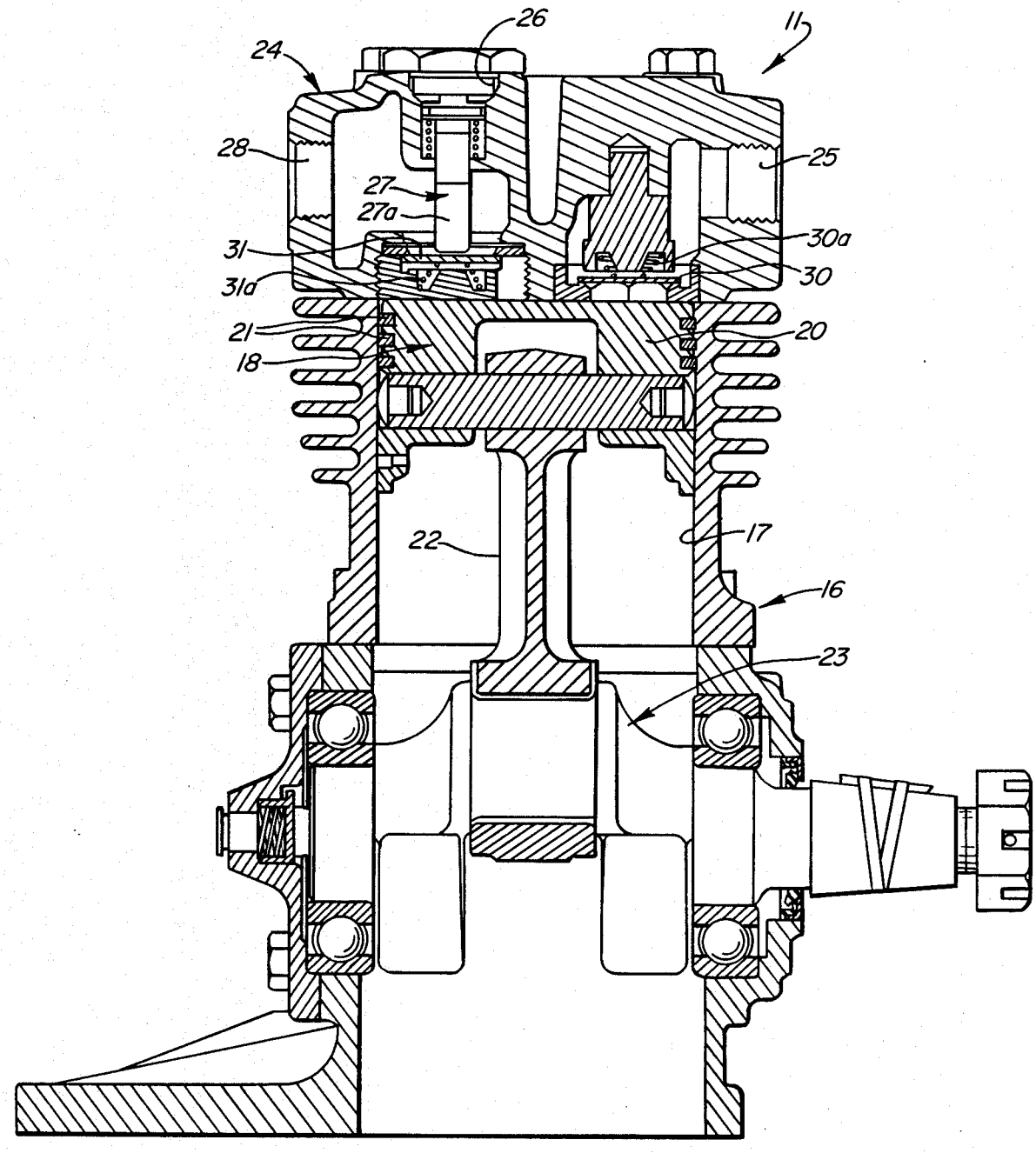
FIG. 2 is an enlarged, fragmentary, vertical sectional view of the air compressor shown in FIG. 1.

Referring now to the drawings and more particularly to FIG. 1, a pneumatic system 10 is shown which is suitable for use in a turbocharged internal combustion engine, not shown. The system 10, as shown incorporates an air compressor 11, the size and capacity of which will depend upon the operational demands imposed thereon; an air dryer 12 of conventional design; a reservoir 13 of charged air; a governor 14; and an isolation valve 15. In certain instances the air dryer might be omitted.

The compressor 11 includes a housing 16 in which is formed one or more cylinders 17. Mounted for reciprocatory movement within each cylinder is a piston 18. The piston 18 may be of conventional design and includes a head section 20 provided with a plurality of circumferential rings 21 and a rod 22 depending therefrom and connected to a suitable crankshaft 23 or the like which provides the driving power for the compressor. The housing 16 also includes a cylinder head section 24 which overlies the upper end of cylinder 17 and is provided with a first port 25 through which charged air is discharged when the compressor is operating in its normal mode. A second port 26 is provided in the head section 24 in which is mounted an unloader device 27, the latter to be described more fully hereinafter. Adjacent to second port 26 of the head section 24 is a third port 28 which functions as the air intake port for the compressor 11. Associated with the first port 25 of the compressor is an exhaust valve 30 which is of conventional design and is biased to assume a closed position by spring **30*a*. An air intake valve 31 is associated with the compressor intake port 28. The valve 31 is biased to assume a closed position by spring 31*a*. Aligned with intake valve 31 and mounted within the compressor second port 26 is the unloader device 27 which includes a plunger 27*a* having an upper end thereof attached to a membrane or the like which is responsive to the pneumatic pressure maintained in line segment 32, see FIG. 1, the latter being in communication with a port 14*a* of governor 14. Plunger 27*a* is adapted to normally assume a retracted position wherein it is out of contact with intake valve. When the pneumatic pressure within the line segment 32 reaches a predetermined amount (e.g., the pressure of the charged air within reservoir 13) the plunger 27***a* will be moved downwardly forcing the air intake valve 31 to assume an open position, as will be explained more fully hereinafter.

The governor 14 is of conventional design and may be preset to respond to certain operating conditions of the turbocharged internal combustion engine with which the pneumatic system is associated. Besides port 14*a*, the governor 14 is provided with a port 14*b* which is connected by a line segment 33 directly to a signal outlet port 34 provided in reservoir 13. The governor 14 is provided with a further port 14*c* which exhausts to the atmosphere.

As will be noted in FIG. 1, line segment 32 is provided with a T-connector 35 from which extends a line segment 36 to the isolation valve 15, as will be described more fully hereinafter.

Besides the signal outlet port 34, the reservoir 13 is provided with an inlet port 37 which is connected by line segment 38 to an outlet port 40 provided in air dryer 12. Reservoir 13 is provided with a third port 41 which is the principal outlet for the charged air and is connected to pneumatically responsive components (e.g. air brakes).

Isolation valve 15, as illustrated, includes a housing 42 having an internal cavity C formed therein. Besides the cavity, housing 42 is provided with a first port 43 to the cavity which is connected by line segment 44 to port 25 of the compressor 11; a second port 45 to the cavity which is connected by a line segment 46 to an inlet port 47 provided in air dryer 12; and a third port 48 to the cavity which is connected by line segment 36 to the T-connector 35. When the dryer is omitted, the second port 45 of the housing will communicate directly with the reservoir inlet port 37.

The housing 42 includes a bottom section 42A in which is formed the cavity C and ports 43 and 45, and an upper section 42B in which is formed the third port 48. The housing sections 42A and B may be threadably connected to one another. Section 42B includes a tubular portion T which projects into the upper open end of cavity C. The lower end of tubular portion T terminates within cavity C above the juncture of the cavity with housing port 43. The upper end of the tubular portion T terminates at an exposed collar Y and may be provided with external threads 50 which mesh with internal threads 51 formed in cavity C adjacent the upper end thereof. A seal ring $R_1$, is interposed the upper end of the tubular portion T and the upper end of cavity C. Collar Y is provided with the housing third port 48 which is axially aligned with tubular portion T and cavity C. The collar abuts the exposed portion of the lower housing section 42B circumjacent the cavity upper end. The interior of the tubular portion is adapted to slidably accommodate the upper end section 52*a* of a primary valve member 52. The lower remaining section 52*b* of valve member 52 is disposed within cavity C. Lower section 52*b* has a rounded closed end 52*c* which is adapted to engage a chamfered seat 45*a* formed at the inner end of port 45 and close off the port when the valve member 52 is in one position of adjustment relative to cavity C. Lower section 52*b* is also provided with an external collar 52*d* which is positioned below the lower end of tubular portion T when the valve member 52 is in a second position of adjustment relative to cavity C. When the valve member is in the second position of adjustment, the first and second ports 43, 45, respectively of the housing 42 are interconnected via the lower portions of cavity C.

Valve member 52 is provided with an internal passage P having an upper segment $P_1$ which terminates at one end at the third port 48 of housing 42. The opposite, or second, end of passage segment $P_1$ terminates within the valve member 52 at a transversely extending lower segment $P_2$ of the passage P. Passage segment $P_2$ terminates at the exterior of the valve member 52 and is in continuous communication with cavity C, see FIG. 1.

Disposed within the internal passage P is a pneumatically responsive secondary valve member 53 which is adapted to move between blocking and unblocking positions relative to the passage segment $P_l$. Valve member 53 includes an imperforate ball 54 and a valve seat piece 55. Piece 55 is adapted to fit within the upper end of passage segment $P_1$, and is provided with a bore 56 which has a smaller diameter than passage segment $P_1$. The bore communicates with the port 48 formed in housing section 42B. When valve member 53 is in the blocking mode, ball 54 sealingly engages the lower end of valve seat piece 55 closing off the end of bore 56. When the valve member 53 is in the unblocking mode, ball 54 drops down passage segment $P_1$, until it comes to rest upon an aligned portion of the lower passage segment $P_2$ whereupon there is clearance around the periphery of the ball to allow air to pass from passage segment $P_1$, to passage segment $P_2$ and then into cavity C.

Valve seat piece 55 may be threaded into the upper end of passage segment $P_1$. A seal ring $R_2$ encompasses the upper end 52*a* of primary valve member 52 and is held in place by an external collar formed on valve seat piece 55. The seat piece collar is sized relative to the interior dimension of the tubular portion T so that the valve seat piece 55 will move in unison with the primary valve member 52 as it moves between open and closed positions with respect to the second port 45.

When the compressor 11 is operating in its normal mode, compressed air is being discharged through the first port 25 to the first port 43 of the housing 42 via the line segment 44. Once the compressed air enters the housing cavity C, the exposed surface of the primary valve member 52 reacts thereto and causes the valve member 52 to move independently upwardly until the external collar 52*d* thereof is positioned below the tubular portion T whereupon there is full communication between ports 43 and 45 of the housing 42. Valve member 52 will remain in its open position so long as the compressor is operating in its normal mode. Simultaneously, with the movement of the primary valve member 52 to its open position, the charged air within the cavity C will cause the ball 54 of the secondary valve member 53 to move upwardly within passage segment $P_1$, until it blocks off bore 56 of the valve seat piece 55. Because the lower passage segment $P_2$ is continuously in communication with cavity C, the ball 54 will always be responsive to the air pressure within the cavity C.

When valve member 52 is in its open position the pressured air will flow from housing port 45 via line segment 46 to the inlet port 47 of the air dryer 12 and then to the inlet port 37 of the reservoir 13 via the line segment 38 connecting inlet port 37 to an outlet port 40 of the dryer.

The line segment 33 which interconnects the signal outlet port 34 of the reservoir with port 14*b* of the governor 14 is continuously charged with air from the reservoir. When the compressor is operating in its normal mode and the preset governor 14 has not been actuated, the ports 14a and 14b of the governor will not be interconnected, thus, charged air will be entrapped within line segment 33. Simultaneously therewith, ports 14a and 14c will be interconnected thereby causing the air within line segments 32 and 36 to be exhausted through the exhaust port 14c of the governor.

Once the governor has been activated, so that ports 14a and 14b are interconnected and port 14c is disconnected from port 14a, the compressor 11 will simultaneously begin its unloading mode. When the governor ports 14a and 14b are interconnected line segment 32 is charged with pressurized air from the reservoir 13 thereby causing unloader device 27, disposed in the second port 26 of the compressor housing section 24, to be activated so that the plunger 27a will contact and open the air intake valve 31 of the compressor. The plunger will retain the air intake valve in its open position so long as the compressor is in the unloading mode. With the air intake valve 31 retained in its open position, two things occur (a) no vacuum or low pressure occurs above the compressive piston head 20 which will cause upward oil leakage past the piston rings 21 and (b) upward movement of the compressor piston 18 within the cylinder 17 will not create sufficient air pressure to open exhaust valve 30. Exhaust valve 30 remains in its closed position because of the force of bias spring 30a and the pressure captured within line segment 44. It is found that the captured air pressure within line segment 44 is initially approximately 65% of the reservoir pressure. However, because of the pressure differential within line segments 36 and 44, the ball 54 of secondary valve member 53 will automatically unseat thereby, causing the pressure within line segment 44 to be quickly replenish by the pressurized air of the reservoir. The pressure within line segment 36 which causes ball 54 to unseat, will also be applied to the relatively larger exposed surface area of the collar of valve seat piece 55 and cause valve member 52 to automatically move downwardly within cavity C until the closed rounded end 52c of the valve member engages and seats on a chamfered end 45a of port 45 thereby closing off port 45. As will be noted valve members 52 and 53 are pneumatically responsive and thus, move automatically when the compressor operation varies between normal and unloading modes.

The isolation valve is of simple, compact design; operates automatically; may be readily installed in existing pneumatic systems; enhances fuel economy; and reduces power loss in a turbocharged internal combustion engine which incorporates the pneumatic system having the isolation valve.

I claim:

1. An isolation valve for use in a pneumatic system having an air compressor adapted to operate in normal and unloading modes and having first and second ports, an air dryer having inlet and outlet ports, a reservoir of charged air having an inlet port and a signal outlet port, the reservoir inlet port being in communication with the dryer outlet port, and a governor having a first port in communication with the reservoir signal outlet port, a second port in communication with the compressor second port, and an exhaust third port, the governor being adapted to effect select communication between the ports thereof under preset conditions; said isolation valve comprising a housing provided with an internal cavity, a first port to the cavity adapted to communicate with the compressor first port, a second port to the cavity adapted to communicate with the dryer inlet port, a third port to the cavity adapted to communicate with the governor second port; a pneumatically responsive primary valve means mounted within said housing cavity for movement between open and closed positions relative to said housing second port, said primary valve means being provided with an internal passage having one end thereof in communication with the housing third port and second end in communication with said housing cavity; and a pneumatically responsive secondary valve means mounted within said passage for independent movement between passage blocking and unblocking positions, said secondary valve means being in said blocking position and said primary valve means being in said open position when the compressor is in the normal mode; said secondary valve means being in an unblocking position, and said primary valve means being in said closed position when the compressor is in an unloading mode and the first and second ports of the governor are in communication with one another.

2. The isolation valve of claim 1 wherein the primary valve means has an exterior portion thereof in engagement with an abutment formed in the housing cavity when the primary valve means is in a fully open position and the compressor is in the normal mode.

3. The isolation valve of claim 1 wherein the second and third ports of the housing are in substantial alignment with one another.

4. The isolation valve of claim 1 wherein the valve housing is of composite construction and includes a body section having the first and second ports and a bore formed therein, the bore having an inner end terminating within the body section adjacent the second port thereof and an outer end terminating at the exterior of the body section, and an end section removably mounted on the body section at the bore outer end; said end section having a protruding, tubular segment disposed in sealing engagement within a portion of said bore, said tubular segment coacting with the remainder of the bore to form the housing internal cavity, said end section including an exposed end segment provided with an opening communicating with the cavity and defining the housing third port.

5. The isolation valve of claim 1 wherein, when the compressor is in an unloading mode and the first and second ports of the governor are in communication with one another, the primary and secondary valve means are adapted to be simultaneously responsive to the pneumatic pressure of the reservoir effecting movement of the primary valve means to a closed position and movement of the secondary valve means to an unblocking position.

6. The isolation valve of claim 5 wherein the primary valve means has a greater surface area exposed to the reservoir pneumatic pressure than that of the secondary valve means.

7. The isolation valve of claim 1 wherein the primary valve means includes a shuttle slidably mounted within said housing cavity, said shuttle having a closed end adapted, when said primary valve means is in the closed position, to sealingly engage a valve seat disposed adjacent said housing second port.

8. The isolation valve of claim 7 wherein the shuttle is elongated and provided with the internal passage, the latter including a first segment extending longitudinally from an end of the shuttle opposite the closed end thereof and having an inner end terminating within the shuttle interior, and a second segment extending angularly from the inner end of the first segment to the exterior of the shuttle at a location longitudinally spaced from the shuttle closed end; the pneumatically responsive secondary valve means disposed within the passage sealingly engaging a valve seat formed within one of the passage segments when said secondary valve means is in the blocking position.

9. The isolation valve of claim 8 wherein the secondary valve means is adjustably mounted within the passage first segment, said first segment being provided with a valve seat piece, the latter including a tubular segment extending towards the passage second segment and terminating within the passage first segment and being sealingly engaged by the secondary valve means when the latter is in the blocking position.

10. The isolation valve of claim 9 wherein the secondary valve means includes an imperforate ball movable between at least the terminating end of the tubular portion of the valve seat piece and the inner end of the passage first segment when the secondary valve means is moving between blocking and unblocking positions.

11. An isolation valve in combination with a piston type air compressor operable in normal and unloading modes and having pneumatically responsive means actuated during the unloading mode to retain a compressor air intake valve in an open condition, said compressor including a first port and a second port, the latter being in communication with the pneumatically responsive means; a reservoir of charged air having an inlet port, a primary outlet port and a signal outlet port; and a governor having a first port in communication with the reservoir signal outlet port, a second port in communication with the compressor second port, and an exhaust third port, the governor being preset to effect communication between the first and second ports thereof when the compressor is operating in the unloading mode; said isolation valve comprising a housing provided with an internal cavity, a first port to the cavity communicating with the compressor first port, a second port to the cavity communicating with the reservoir inlet port, and a third port to the cavity communicating with the governor second port; a pneumatically responsive primary valve means mounted within said cavity for movement between open and closed positions relative to the housing second port, said primary valve means being provided with an internal passage having one end thereof in communication with the housing third port and a second end in communication with said housing cavity; and a pneumatically responsive secondary valve means mounted within said passage for independent movement between passage blocking and unblocking positions; said secondary valve means being in said blocking position and said primary valve means being in said open position when said compressor is in the normal mode; said secondary valve means being in said unblocking position and said primary valve means being in said closed position when said compressor is in the unloading mode and the first and second ports of the governor are in communication with one another.

12. The isolation valve of claim 11 wherein the second port of the isolation valve housing communicates with an inlet port formed in an air dryer and the reservoir inlet port communicates with a discharge port formed in the air dryer.

* * * * *